US006542079B1

(12) United States Patent
Kahl, Sr.

(10) Patent No.: US 6,542,079 B1
(45) **Date of Patent: *Apr. 1, 2003**

(54) INFRARED DETECTION AND ALARM SYSTEM FOR BOTTOM SHELF OF SHOPPING CART

(76) Inventor: Robert A. Kahl, Sr., 1828 Tribute Rd., Suite H, Sacramento, CA (US) 95815

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,216

(22) Filed: Feb. 18, 2000

(51) Int. Cl.[7] ..... G08B 13/14

(52) U.S. Cl. ..... 340/568.5; 340/539; 340/555; 340/556; 340/691.1; 250/222.1

(58) Field of Search ..... 340/568.5, 568.1, 340/568.2, 568.8, 568.6, 568.7, 569, 570, 571, 540, 539, 555, 556, 557, 933, 691.1; 250/222.1, 221, 223 R

(56) References Cited

U.S. PATENT DOCUMENTS

| | | | | | |
|---|---|---|---|---|---|
| 3,725,894 | A | * | 4/1973 | Geisler | 340/568 |
| 3,996,950 | A | * | 12/1976 | Mier | 135/45 R |
| 4,266,193 | A | * | 5/1981 | Most et al. | 324/236 |
| 4,327,819 | A | | 5/1982 | Coutta | |
| 4,338,594 | A | * | 7/1982 | Holm | 340/568 |
| 4,470,495 | A | * | 9/1984 | Unger | 250/222.1 |
| 4,723,118 | A | | 2/1988 | Hooley et al. | |
| 4,725,822 | A | * | 2/1988 | Hooley | 340/568 |
| 4,736,098 | A | | 4/1988 | Rehrig | |
| 5,210,406 | A | * | 5/1993 | Beran et al. | 250/221 |
| 5,485,006 | A | | 1/1996 | Allen et al. | |
| 5,495,102 | A | * | 2/1996 | Fine | 250/222.1 |
| 5,500,526 | A | * | 3/1996 | Shalvi et al. | 250/222.1 |
| 5,610,584 | A | | 3/1997 | Schrade | |
| 5,646,616 | A | * | 7/1997 | Komatsu | 340/988 |
| 5,679,941 | A | * | 10/1997 | Iizaka et al. | 235/383 |
| 5,711,162 | A | * | 1/1998 | Wolanin et al. | 62/302 |
| 5,883,968 | A | * | 3/1999 | Welch et al. | 382/100 |
| 5,910,769 | A | | 6/1999 | Geisler | |
| 6,107,928 | A | * | 8/2000 | Gatti | 340/686.1 |

OTHER PUBLICATIONS

Store–Scan, Inc., With Store–Scan's C.O.S.T. System You Can Always be Sure it will be Profit, Feb. 1, 1999, entire brochure.

* cited by examiner

*Primary Examiner*—Nina Tong
(74) *Attorney, Agent, or Firm*—Theodore J. Bielen, Jr.

(57) ABSTRACT

An infrared detection and alarm system for the bottom shelf of shopping carts having attached to the bottom shelf an infrared emitter which shall emit therefrom infrared light which shall be received by an infrared detector when no merchandise is located on the bottom of the cart and if a piece of merchandise is located on the bottom shelf the light shall be interrupted. Upon interruption of the light, a transmitter shall communicate a code to a receiver mounted on the checkout stand at which point said receiver shall activate an LED warning light to communicate to the sales clerk the presence of merchandise on the bottom shelf of the shopping cart.

9 Claims, 16 Drawing Sheets

PHOTOTRANSISTORS: LITEON LTR-4206E OR EQUIV.

FIG. 4B-2

| QUANTITY | COMPONENT | OFF +3V MAX CURRENT | UNIT COST |
|---|---|---|---|
| 1 | PRINTED CIRCUIT BOARD (PCB) | 0 | ? |
| 2 | BATTERY, 3.6V, 2250 MAH, SAFT LS14500 OR EQUIV. | 0 | 2.600 |
| 2 | BATTERY CONNECTOR PAIR | 0 | ? |
| 1 | PIC16C57C-04/SO | 40 UA (WDT DISABLED) | 1.810, DIGIKEY |
| 1 | CRYSTAL, 38 KHZ | 0 | 0.550, DIGIKEY |
| 9 | EMITTING DIODE, LITEON LTE-4206 OR EQUIV. | 0 | 0.300, DIGIKEY |
| 7 | PHOTO TRANSISTOR, LITEON LTR-4206E OR EQUIV. | 0 | 0.270, DIGIKEY |
| 8 | CAPS, 0.1 UF, 1206, 10%, X7R | 0 | 0.086, DIGIKEY |
| 1 | MICROCHIP 93LC46A | 1 UA | 0.310, DIGIKEY |
| 1 | CD4011 | 1 UA | 0.248, DIGIKEY |
| 1 | LM339 | 0 | 0.150, DIGIKEY |
| 37 | RESISTORS, 1206, 5% | 0 | 0.00473, DIGIKEY |
| 5 | 2N4401 | 0 | 0.022 |
| 4 | 2N4403 | 1 UA | 0.022 |
| 2 | CAPS, 12 PF, 1206, 5%, NPO | 0 | 0.036, DIGIKEY |
| | 2 MA, 5 MS ON, 100 MS OFF | 100 UA | |
| | TOTAL | 143 UA | 9.9019 + PCB |

365.25 DAYS/YEAR X 24 HOURS/DAY = 8766 HOUR/YEAR
MAXIMUM: 0.143 MA X 8766 HOURS/YEAR X 3 VOLTS = 1254 MAH X 3 VOLTS/YEAR

| | |
|---|---|
| FIG. 5B-1 | FIG. 5B-2 |
| FIG. 5B-3 | FIG. 5B-5 |

INFRARED DETECTION AND ALARM SYSTEM FOR BOTTOM SHELF OF SHOPPING CART

FIELD OF THE INVENTION

The following invention relates generally to the reduction of shrinkage for businesses. More particularly, the instant invention monitors for articles that could be obscured from the view of employees. In particular, the instant invention seeks to detect whether or not articles have been placed within an area that could avoid detection by employees during their normal course of routines associated with their duties. More specifically, the instant invention monitors a surface or surfaces of a cart used to transport articles. More specifically, the instant invention detects whether or not articles have been placed proximate a shelf. Once the instant invention detects the presence of an article or articles, the instant invention notifies the appropriate employees of the business.

The present invention employs infrared emitters and detectors, mounted to the bottom shelf of a shopping cart basket and directed toward one another, in order to detect articles placed on said bottom shelf and enabling the unit to transmit a signal to a receiver mounted at the checkout stand, which will trigger an alarm in order to signify the presence of such articles to a clerk utilizing said checkout stand.

BACKGROUND OF THE INVENTION

Grocery stores, supermarkets, and other retail establishments commonly supply consumers with shopping carts in order to provide them with a means to collect all articles of merchandise the consumer wishes to purchase. Typically, the shopping cart is wheeled to the checkout stand and the items are unloaded either by the consumer, in the case of self service establishments, or by the clerk in full service establishments. This process allows inputting of the price of the merchandise into a point of sale system and to transfer said merchandise into paper or plastic disposable bags that are then taken from the store by the consumer.

It is often the case that shopping carts are designed in a manner which provides a primary basket as well as a lower shelf that is below the primary basket and just above the wheels of said cart. The lower shelf is frequently used for transporting bulky items such as of beverages, pet foods, expensive and dense quantities of meats and produce. Because said lower shelf is typically six (6) inches to one (1) foot from the ground, clerks employed by the retail establishment, either inadvertently or purposefully, often fail to remove articles of merchandise from said bottom shelf, thus precluding the entry of prices into the point of sale system, thereby increasing the shrinkage cost of the grocery or retail establishment.

Because of such loss, inventors created several inventions designed to prevent the aforementioned occurrence and to provide retailers with one solution to the growing problem of shrinkage in its various forms.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. Pat. No. | ISSUE DATE | INVENTOR |
|---|---|---|
| 4,327,819 | May 4, 1982 | Coutta |
| 4,723,118 | February 2, 1988 | Hooley, et al. |
| 4,736,098 | April 5, 1988 | Rehrig |
| 5,485,006 | January 16, 1996 | Allen, et al. |
| 5,495,102 | February 27, 1996 | Fine |
| 5,610,584 | March 11, 1997 | Schrade |
| 5,883,968 | March 16, 1999 | Welch, et al. |
| 5,910,769 | June 8, 1999 | Geisler |

Non Patent Literature

Store-Scan, Inc., With Store-Scan's C.O.S.T. System You Can Always Be Sure It Will Be Profit, Feb. 1, 1999, entire brochure.

U.S. Pat. No. 5,610,584 to Schrade discloses a system of employing optical devices at equal levels on both sides of the alleyway of the checkout stand. When the beam emitted from one device to the other is broken by an object of any kind, a signal is sent to the clerk via a receiver wired into the checkout stand that alerts them to the fact that articles are present upon the bottom shelf of the shopping cart. Whereas the present invention requires a simple and non destructive method of installation and implementation, the Schrade invention is cumbersome because it requires the modification and reconstruction of existing checkout stands. In contrast, the present invention simply requires the mounting of sensor units onto the bottom of the primary larger basket, and the wiring of the checkout stand receiver in order to access a power source and to provide proper placement of the checkout stand LED indicator.

Furthermore, the Schrade invention claims it is intended to operate within a retail environment in which the consumer is responsible for placing the articles of merchandise onto the sales counter. In contrast, the present invention is adaptable to all retail environments that utilize shopping carts because the unit is attached to the cart itself, thereby allowing convenient and cost effective conformity of the system to each retail environment based upon varying dimensions of checkout stands and the like.

U.S. Pat. No. 5,495,102 to Fine employs a system similar to the Schrade invention, but does allow for the implementation of said system in a retail environment that employs full service checkout stands in which store employees remove merchandise from the carts and place them onto the counter for processing. However, the Fine invention must be adapted to a pre-existing point of sale (POS) system in order to operate. The signal indicating the presence of articles on the bottom rack of the cart is sent to the cash register itself which then communicates a message to the sales clerk and/or disallows them from further proceeding with the transaction without the entry of the said articles of merchandise into the POS system. The present invention requires no interfacing with existing POS system, nor does it require the creation of new POS systems in order for the device to effectively communicate to the sales clerk the as to the presence of merchandise on the bottom shelf of the shopping cart.

Furthermore, the Fine invention is unable to discern from articles placed on the bottom shelf of a shopping cart and objects such as humans positioned in the alleyway, and shopping carts that are not perfectly aligned with the predetermined point required to trigger the optical transmitter system, thus subjecting the unit to false readings. In time, the false readings will have the effect of conditioning the clerks employed by the retail establishments to ignore such false readings, thereby resulting in the clerks ignoring of true positive readings and the clerks will develop the habit of simply entering the override code and proceeding further without accounting for merchandise placed on the bottom shelf of the cart. This even further exacerbates the shrinkage problem already experienced by retailers.

U.S. Pat. No. 5,485,006 to Allen, et al., also requires physical implementation into the checkout stand and relies upon the movement and subsequent stoppage thereof, by the cart itself before a signal is transmitted by the unit attached to the cart and received by the unit mounted at the checkout stand. Because said tasks are performed in such order by the present invention, there is no need for the shopping cart to be positioned exactly in a predetermined space in order to operate effectively.

Another attempted solution to the problem of bottom shelf merchandise shrinkage was that of U.S. Pat. No. 4,736,098 to Rehrig. In said invention, a conventional shopping cart must be adapted by including a pair of biasing springs and a reflector on the bottom tray, such that a checkout aisle photoelectric assembly is triggered by passage of a cart through the checkout stand aisle the photoelectric assembly is triggered by passage of a cart through the checkout stand aisle only when a load is on the bottom tray. This solution is ineffective in detecting the presence of any articles of insufficient weight, whereas the present invention would be able to detect an article with lower density, such as a newspaper or magazine.

In U.S. Pat. No. 4,723,118, to Hooley, the shopping cart tray is pivotably movable between loaded and unloaded positions to displace a permanent magnet mounted to the cart, the magnetic field of which interacts with a control circuit in the checkout stand. This system causes consumer inconvenience by requiring them to reposition the bottom tray of the cart before the tray is available to a consumer. The present invention will not inconvenience the consumer whatsoever, and in most instances the consumer will most likely be unaware of the presence of such a detection system.

One system, described in U.S. Pat. No. 4,327,819 to Coutta involves the use of a specially designed plastic tray which replaces the bottom tray of the conventional shopping cart. In the Coutta system, the shopping cart is modified so that the existing bottom tray must be removed completely or overlaid with the specially designed plastic tray. The present invention overcomes this costly and time consuming retrofitting with a simple and easily mounted unit.

The other prior art listed above but not specifically described herein further catalog the prior art of which the applicant is aware. These references diverge even more starkly from the references specifically distinguished above.

SUMMARY OF THE INVENTION

Accordingly, it is an object of this invention to overcome the disadvantages of the prior art by providing an effective and unintrusive method of detecting the presence of articles of merchandise on the bottom shelf of a shopping cart using a cart mounted detection system that communicates such fact to the sales clerk.

This objective is achieved through a novel and non-obvious shopping cart merchandise detector, comprising in combination a basket, a frame supporting the basket that includes a chassis underlying the basket from which wheels depend. Juxtaposed to the chassis is a sensing means having a driving means at a first extremity of the chassis and receiving means at a second extremity of the chassis. The sensing means operatively coupled to detect merchandise on the chassis. Further included is a communication link between the sensing means and a checkout stand having means to signal a cashier of the merchandise on the chassis.

This objective is also achieved through a method of sensing merchandise on a shopping cart's payload area with the steps of: orienting sensors to scan the payload area; scanning with the sensors the payload area to determine the presence of merchandise of the chassis; and communicating to a cashier the presence of merchandise.

This objective is also achieved through a method for sensing merchandise on a shopping cart's payload area with the minimization of power consumption, the steps including: initially residing in a quiescent state; mobilizing to a non-quiescent state when stimulated by an emission from a checkout stand; establishing a rule set for package surveillance based on the probability of discovery; embarking on a first most probable scan strategy calculated to reflect the most likely area for the package; reporting the existence to the checkout stand; and if not found, initializing a search in less probable areas.

This objective is also achieved through a method for reducing pilferage in a commercial establishment, the steps including: scanning with sensors a payload area for merchandise; and communicating to the commercial establishment the presence of merchandise.

This objective is also achieved through a land vehicle for carrying at least one article and for informing of a presence the at least one article comprising: a surface for the placement of at least one article thereon; and a means for detecting the presence of at least one article placed on the surface.

This objective is also achieved through an energy efficient method for sensing merchandise on a shopping cart's payload area, steps including: initially residing in a quiescent state; mobilizing to a non-quiescent state when stimulated by an emission from a checkout stand; establishing a rule set for package surveillance based on the probability of discovery; embarking on a first most probable scan strategy calculated to reflect the most likely area for the package; reporting the existence to the checkout stand; and if not found, initializing a search in less probable areas.

OBJECTS OF THE INVENTION

Viewed from a first vantage point, it is an object of the present invention to provide a method of sensing merchandise on a shopping cart's payload area with the steps of: orienting sensors to scan the payload area; scanning with the sensors the payload area to determine the presence of merchandise of the chassis; and communicating to a cashier the presence of merchandise.

Viewed from a second vantage point, it is an object of the present invention to provide a method for sensing merchandise on a shopping cart's payload area with the minimization of power consumption, steps including: initially residing in a quiescent state; mobilizing to a non-quiescent state when stimulated by an emission from a checkout stand; establishing a rule set for package surveillance based on the probability of discovery; embarking on a first most probable scan strategy calculated to reflect the most likely area for the package; reporting the existence to the checkout stand; and if not found, initializing a search in less probable areas.

Viewed from a third vantage point, it is an object of the present invention to provide a method for reducing pilferage in a commercial establishment, the steps including: scanning with sensors a payload area for merchandise; and communicating to the commercial establishment the presence of merchandise.

Viewed from a fourth vantage point, it is an object of the present invention to provide a land vehicle for carrying at least one article and for informing of a presence the at least one article comprising: a surface for the placement of at least one article thereon; and a means for detecting the presence of at least one article placed on the surface.

Viewed from a fifth vantage point, it is an object of the present invention to provide an energy efficient method for sensing merchandise on a shopping cart's payload area, steps including: initially residing in a quiescent state; mobilizing to a non-quiescent state when stimulated by an emission from a checkout stand; establishing a rule set for package surveillance based on the probability of discovery; embarking on a first most probable scan strategy calculated to reflect the most likely area for the package; reporting the existence to the checkout stand; and if not found, initializing a search in less probable areas.

Accordingly, besides the objects and advantages of the detection and alarm system described supra, several other objects and advantages of the present invention are as follows:

(a) to provide a device that will alert a sales clerk in a retail environment of the presence of articles of merchandise on the bottom shelf of a shopping cart that provides no inconvenience to the consumer in said retail environment;

(b) to provide a device that will alert a sales clerk in a retail environment of the presence of articles of merchandise on the bottom shelf of a shopping cart that provides no inconvenience to the sales clerk;

(c) to provide a device that will alert a sales clerk in a retail environment of the presence of articles of merchandise on the bottom shelf of a shopping cart that will not be prone to false readings caused by humans or other objects;

(d) to provide a device that will alert a sales clerk in a retail environment of the presence of articles of merchandise on the bottom shelf of a shopping cart that will detect smaller items that were previously undetectable by existing systems;

(e) to provide a device that will alert a sales clerk in a retail environment of the presence of articles of merchandise on the bottom shelf of a shopping cart that will be cost effective in that it requires no reconstructing of existing checkout stands used in the retail environment;

(f) to provide a device that will alert the sales clerk in a retail environment of the presence of articles of merchandise on the bottom shelf of a shopping cart that will be not interfere with operation of the cart;

(g) to provide a device that will alert a sales clerk in a retail environment of the presence of articles of merchandise on the bottom shelf of a shopping cart that will attach to pre-existing carts and will not require design and creation of specially designed carts or bottom shelves of said pre-existing carts.

Furthermore, the detection and alarm system has additional advantages in that:

it attaches directly to pre-existing shopping carts in a manner which is not labor intensive; it attaches to the shopping cart in a manner which does not interfere with the normal operation of the cart by the consumer, the retailer, or by a clerk nesting said cart with other carts;

it does not require the reconstructing of existing checkout stands;

it employs infrared technology having a wide field of vision, thus allowing for the detection of products of varying size and weight;

it attaches directly to the cart itself, which will minimize the instances of false readings as the area in which it is monitoring is typically not an area available to human movement or objects other than merchandise;

it is energy efficient in its operation;

it is durable in its design and shall provide a lasting solution to retailers in minimizing retail shrinkage.

These and other objects will be made manifest when considering the following detailed specification when taken in conjunction with the appended drawing figures.

DESCRIPTION OF PREFERRED EMBODIMENTS

Figure 1:
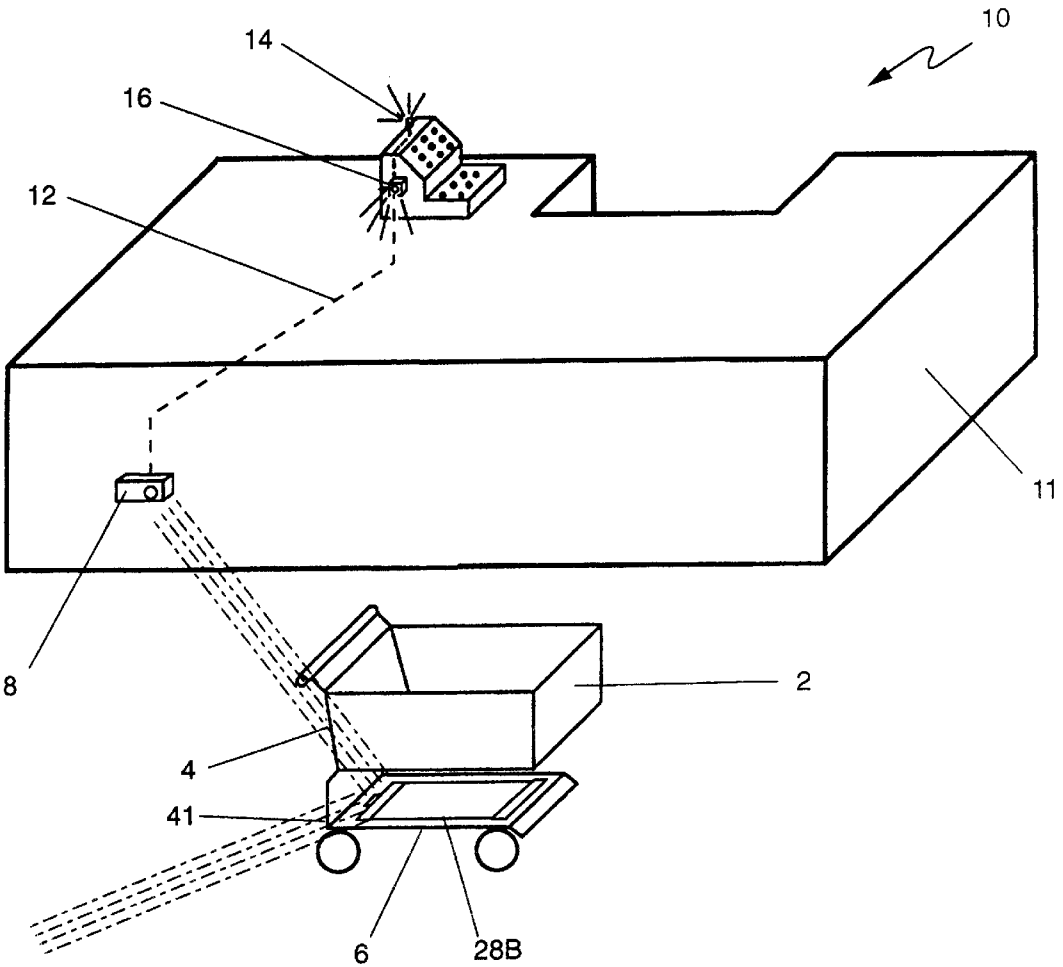
FIG. 1 is a view of the overall invention.

Considering the drawings, wherein like reference numerals denote like parts throughout the various drawing figures, reference numeral 10 is directed to the shopping cart merchandise detector according to the present invention.

FIG. 1 shows the overall system for the present invention 10. As shown within FIG. 1, shopping cart 2 includes a chassis 6 forming a shelf to place articles thereon and a basket 4 to place articles therein. Juxtaposed the chassis is the assembly 20 containing the cart circuitry 50, see FIGS. 2, 4A and 4B. Within the checkout stand 11 is the checkout stand assembly 8 that contains the contains part of the checkout stand circuitry 100. Connection 12 electrically couples visual indicator 14 and audible indicator 16 to the remaining checkout stand circuitry within 8.

Figure 2:
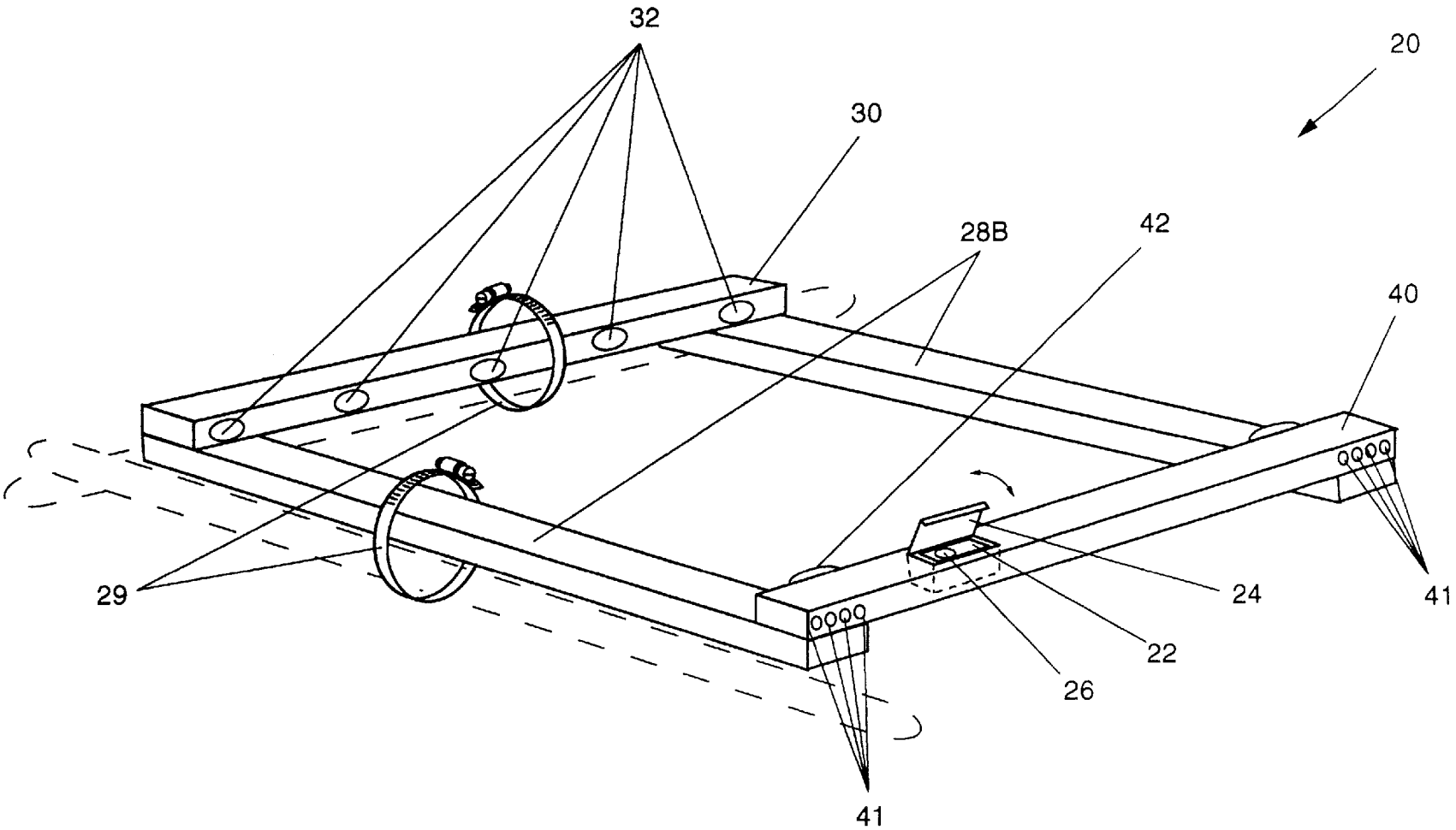
FIG. 2 is a view of the assembly that is juxtaposed the chassis and contains the cart circuitry.
Figure 7:
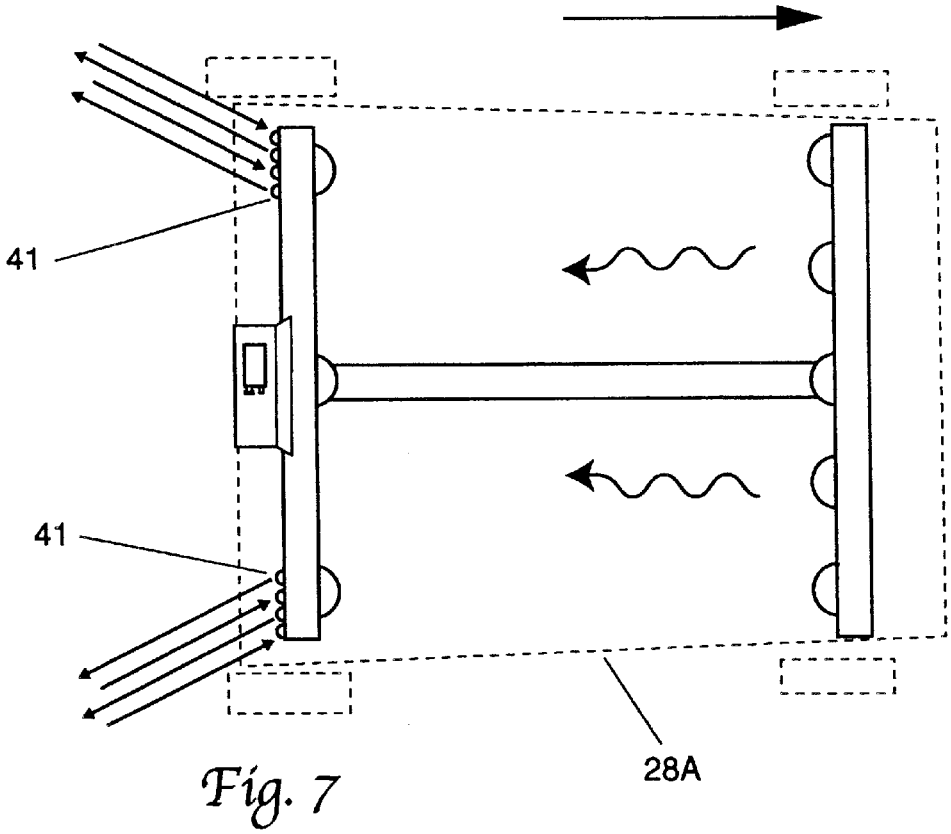
FIG. 7 shows the cart direction vis-a-vis the path of infrared light for scanning and for bidirectional communication between the cart circuitry shown in FIGS. 4A and 4B and the checkout stand circuitry shown in FIGS. 5A and 5B.

FIG. 2 shows the assembly 20. The assembly 20 includes an emitter array 30 and a detector array 40. The emitter array contains five light emitting diodes (LED) 32. The detector array 40 includes three phototransistors 42 that are utilized to detect infrared light coming from, in particular, LEDs 32. Cross-members 28B hold the emitter array 30 and detector array 40 in a spaced apart relationship and contain the wiring necessary for the connection of the two arrays to the remaining cart circuitry 50 found in FIGS. 4A and 4B. Alternatively, as shown in FIG. 7, the cross-member 28A could constitute a singular member bisecting the arrays 30 and 40 to hold the arrays 30 and 40 in a spaced apart relationship and contain the wiring necessary for the connection of the two arrays 30 and 40 to the remaining cart circuitry 50 found in FIGS. 4A and 4B. Proximate a distal end of the receiver array 40 is power source chamber 22 that has a lid 24 hinged at one end to at least permit access to the interior of power source chamber 22 containing power source 26. Thus, receiver array 40 is a housing that contains a majority of the cart circuitry 50, including the power supply for the cart circuitry 50, but excluding the emitters on the emitter array 30. Also, within assembly 22 is a removable power supply 26 that is a battery, preferably a 3 volt or 3.6 volt lithium battery or batteries.

Also shown in FIG. 2 are clamping means 29 that permit the securing of the cart assembly 20 to the chassis 6 of pre-existing shopper cart 2 in a manner which is not labor intensive. The clamping means 29 are constructed to permit the assembly 20 to attach to the spokes (not shown) that form the grid pattern (not shown) of the chassis 6 of a shopping cart 2. This arrangement is advantageous because it permits the assembly 20 to be secured to almost all shopping carts with ease and minimal cost associated with such retrofitting.

Figure 3A:
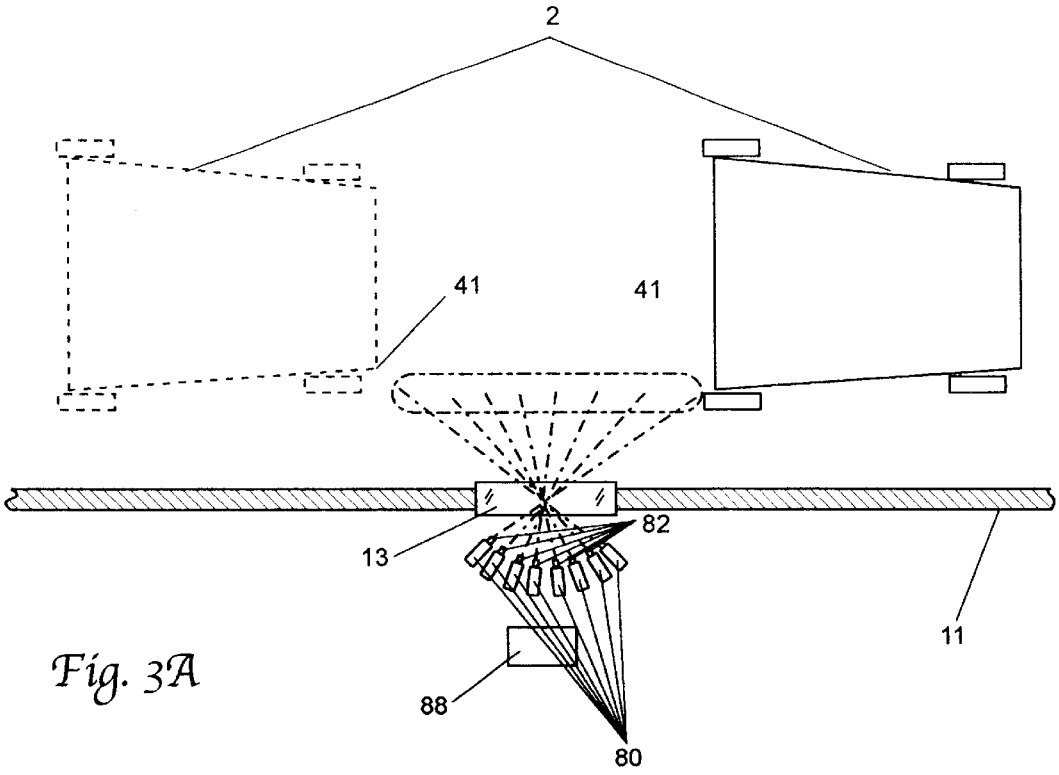
FIGS. 3A and 3B are views of the arrangement of the checkout stand's emitters and receiver.
Figure 3B:
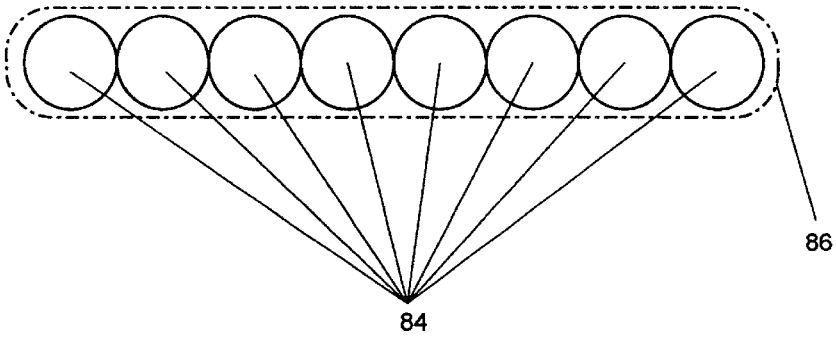

FIGS. 3A and 3B show the preferable positioning for the checkout stand emitter array and communication receiver 88. Preferably the emitter array includes eight LED driver circuits 80 spaced apart in an arc arrangement as shown in FIG. 3A; however, sixteen LED driver circuits could be used in a similar arc arrangement. There is a small opening 13 about two inches in diameter within the checkout stand 11. The light from the LEDs 82 converge at the opening 13 and then diverge to a wide spread so that it will be possible to detect the presence of a shopping cart for a longer time. The arrangement provides a wide area for the communication between the cart circuitry 50 and the checkout stand circuitry to occur. As seen in FIG. 3B the positioning of the LED drivers 80 in such a manner as shown makes each small diameter spot of light 84 projected from each LED 82 juxtaposed to one another. This geometry yields a wide and narrow oval shape 86 as shown in phantom within FIG. 3B. The spread geometry of the signal sent from the LED drivers 80 and LEDs 82 permit the circuits on the shopping cart to be of simple design and minimal power drain.

FIG. 3A also shows checkout stand receiver 88. It only receives, but it has a very wide range angle for reception. The receiver 88 is essentially a two stage filter. The first stage is analog in that the receiver 88 is set only accept signals that are 38 kilohertz of carrier frequency and that also fall into the infrared spectrum. The second stage is digital in that after detecting a 38 kHz signal it checks to see if that signal is a valid code signal, a series of ones and zeros 14 bits long, and then checks whether the code is for a package has been detected by the cart circuitry 50. All codes received by the receiver 88 are considered invalid unless the code conforms to the "package has been detected code" or "package has not been detected code" sent by the cart circuitry 50.

Figure 4A:
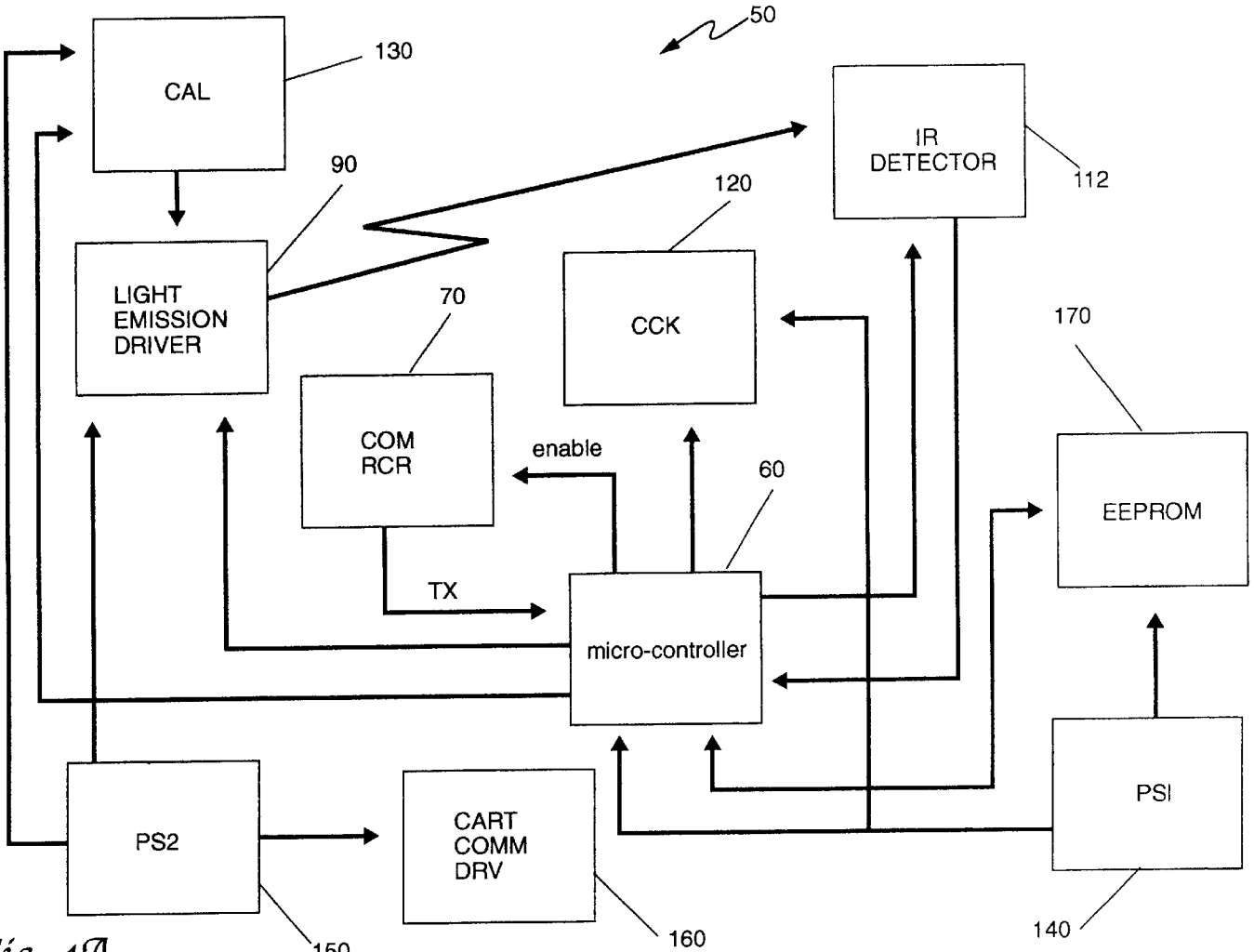
FIG. 4A is a block diagram overviewing the cart circuitry.
Figures 1, 4B:
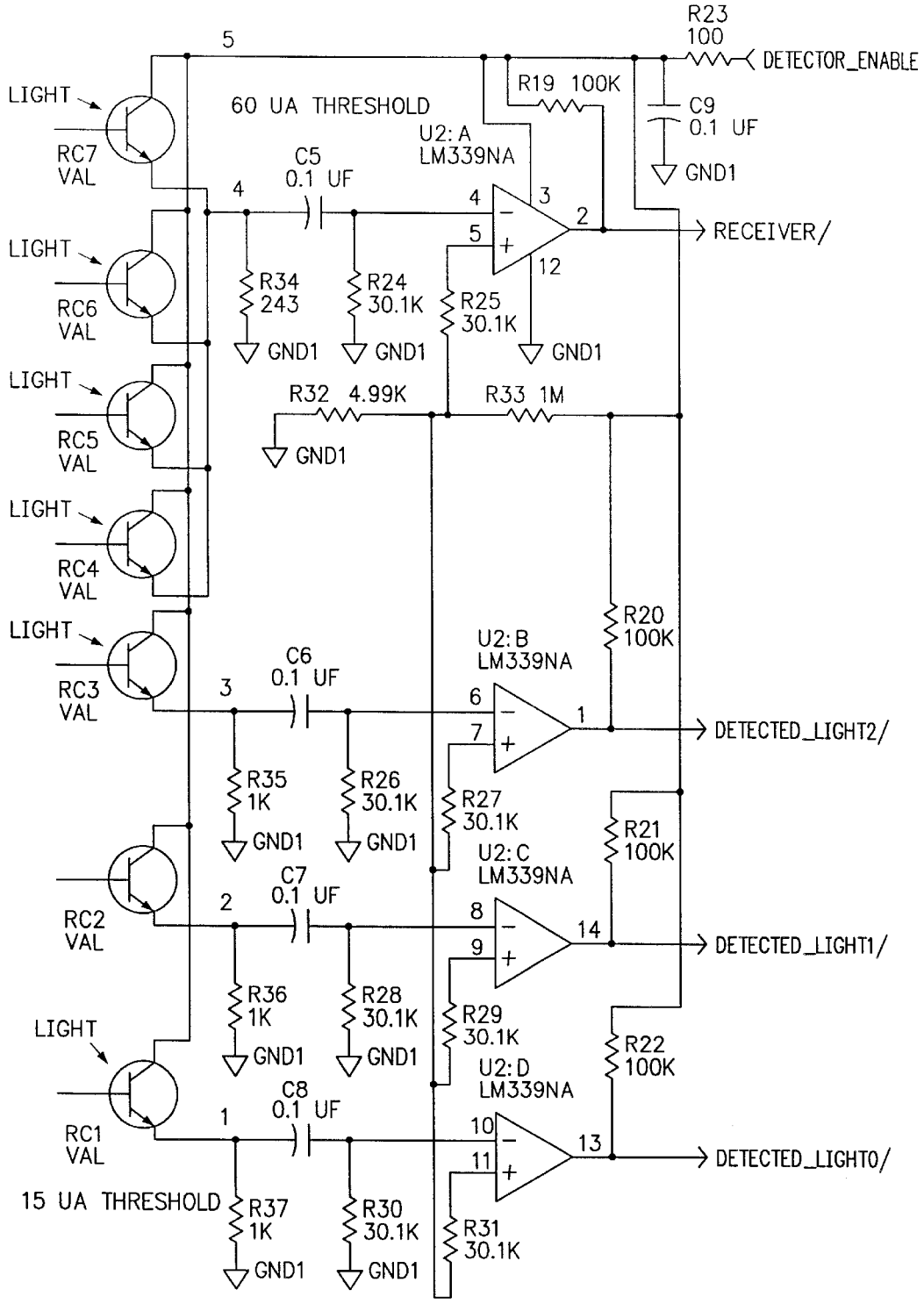
FIG. 4B is a schematic diagram of the preferred embodiment of the cart circuitry.
Figures 3, 4B:
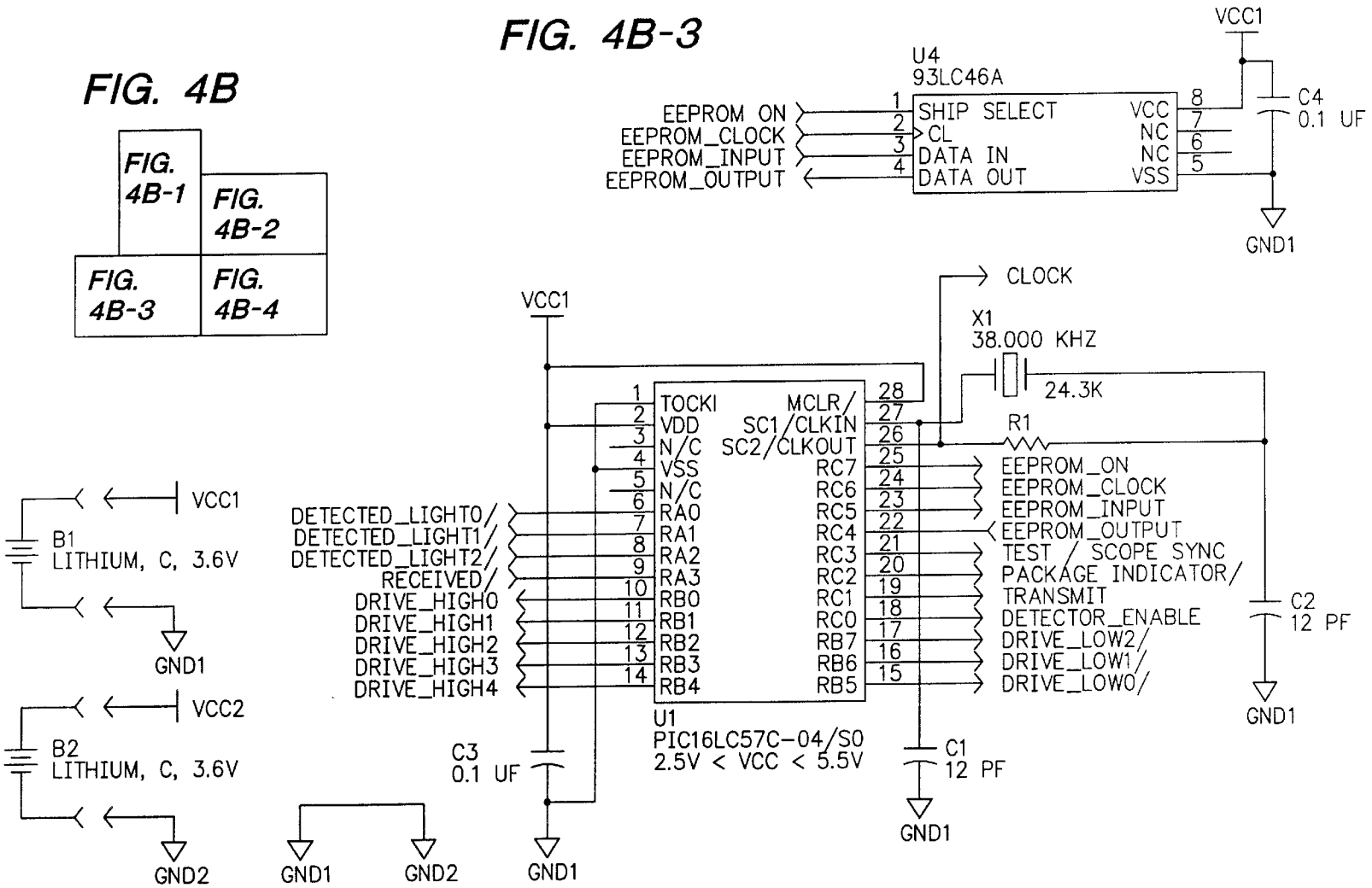
Figures 4, 4B:
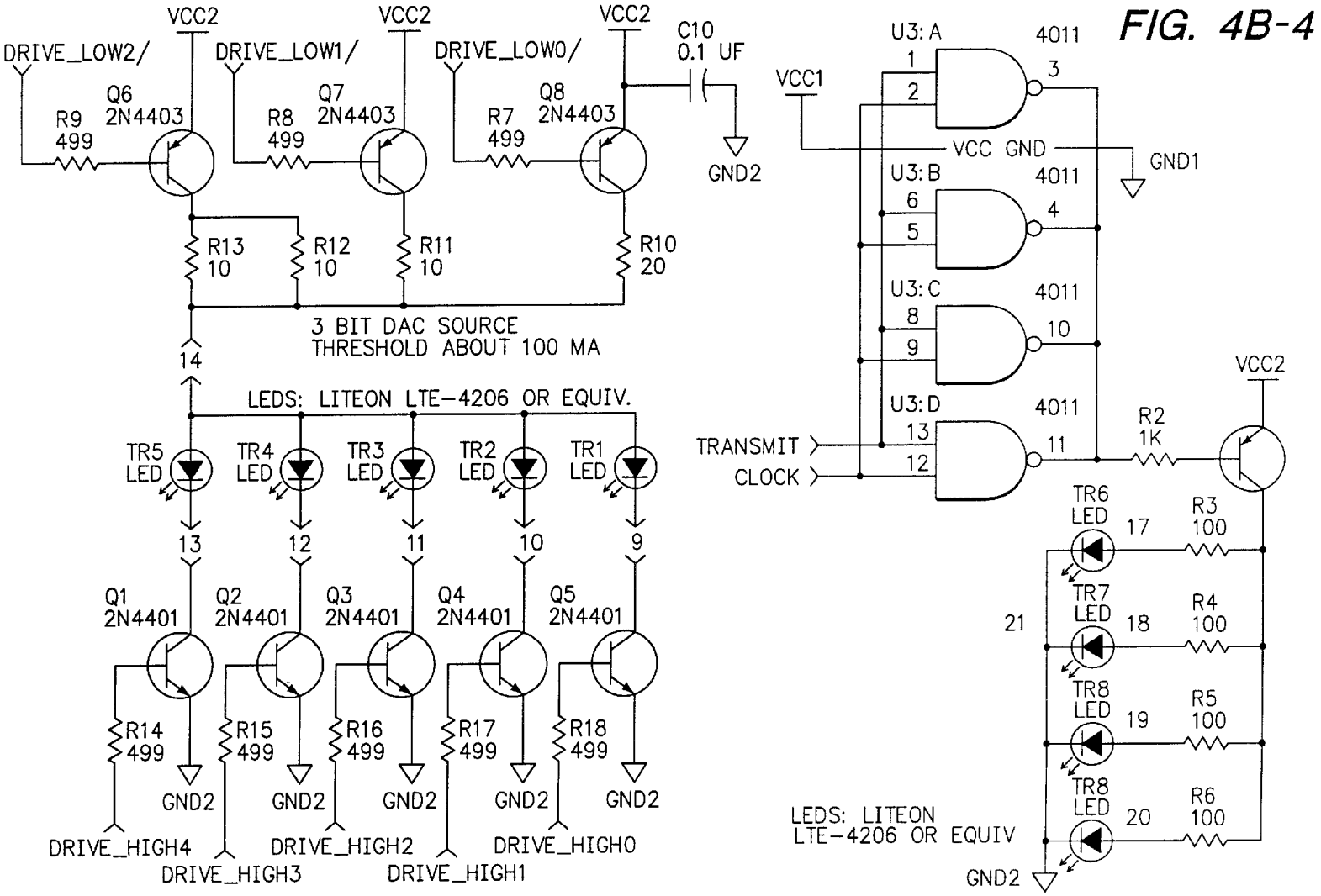

FIG. 4B is the cart's schematic and FIG. 4A is a block diagram for overviewing the cart's schematic. Viewing FIG. 4B, on the left side are the communication receiver 70 and infrared (IR) detector 112. Communication receiver 70 includes four phototransistors and a comparator. IR detector 112 includes three phototransistors and three comparators. In the center and on the right are the emitting circuits, light emission driver 90 and cart communication driver 160. Light emission driver 90 includes five LEDs. Cart communication driver 160 includes four LEDs. For package detection, only the bottom three phototransistors and the five LED drivers are utilized. What happens when the system is looking for a package is infrared light from the light emission driver 90 is sent straight across to the IR detector 112.

Figure 6:
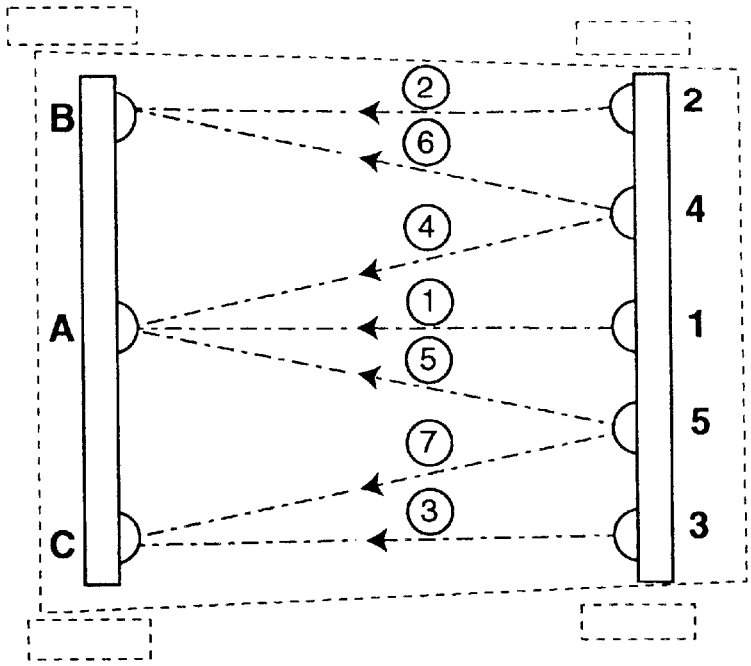
FIG. 6 shows the seven scanning patterns utilized by the present invention.

FIG. 6 demonstrates the "rule set" or pattern of scanning by sensors formed from pairs of drivers and detectors. Power goes first to the driver 1 in the center and to the detector A in the center, which is the most probable line for a package location. Next power goes to driver 2 and detector B. Then power goes to driver 3 and detector C. Then power goes to driver 4 and detector A. Then power goes to driver 5 and detector A. Then power goes to driver 4 and detector B. Then power goes to driver 5 and detector C. So there are seven different combinations of paths and the system is designed to look for a package in the most likely place, within the center of the shelf before extending to the extremities, thus conserving the limited power available to the system.

Three transistors comprise the calibration circuit 130 (FIGS. 4A and 4B). The calibration circuit 130 is used to initiate which combination of LED driver and phototransistor detector are going to be on during the scan of a package's presence. Calibration circuit 130 is used to save the battery and to use just the right amount of current to detect whether there is a package or not. If too little current is used then a package might be detected that really isn't there, because the light instead of being blocked is not strong enough to be received by IR detector 112. If the current is too large, then the package might not be detected because the light bounces off of other surfaces.

The calibration within the calibration circuit 130 is done during the assembly process. The overall system is calibrated initially for each combination of the possible seven light emission driver and detector combinations shown in FIG. 6. The microcontroller 60 adjusts to where just the right amount of current to trigger whether there is a package or not when there is no package, i.e. the right amount of infrared light that is to be emitted in order for the light to be detected by the phototransistor. This progress is repeated to the next combination of light emission driver and detector and the system stays at that point. Then microcontroller 60 remembers what current is required for a particular path of combination light emission driver and detector, as shown in FIG. 6. Each combination has a different calibration value. So there are seven different calibrations at work that are stored by microcontroller 60. The resistors within the calibration circuit 130 are binary weighted so that there are seven equal segments of different calibration values.

The power supply is battery operated and it is divided into two circuits 140 and 150. Power supply 140 (PS1) is for the microcontroller and provides a steady value because these circuits are sensitive to disturbances caused by heavy current flow. Power supply 150 (PS2) is for where the circuit has a lot of current flowing, like on the light emission driver 90 and cart communication driver 160. Because a lot of current is flowing to these circuits, a lot of disturbances are created; however, these circuits are not as sensitive to those disturbances. By not isolating the heavy current flowing circuits from the microcontroller 60 power glitches generated by the disturbances would cause an error in the microcontroller 60. Also, separating the power supply into two sources will allow the use of microfarad ceramic capacitors and not the highly leaky (and high battery drain) aluminum high value capacitors.

Figure 8A:
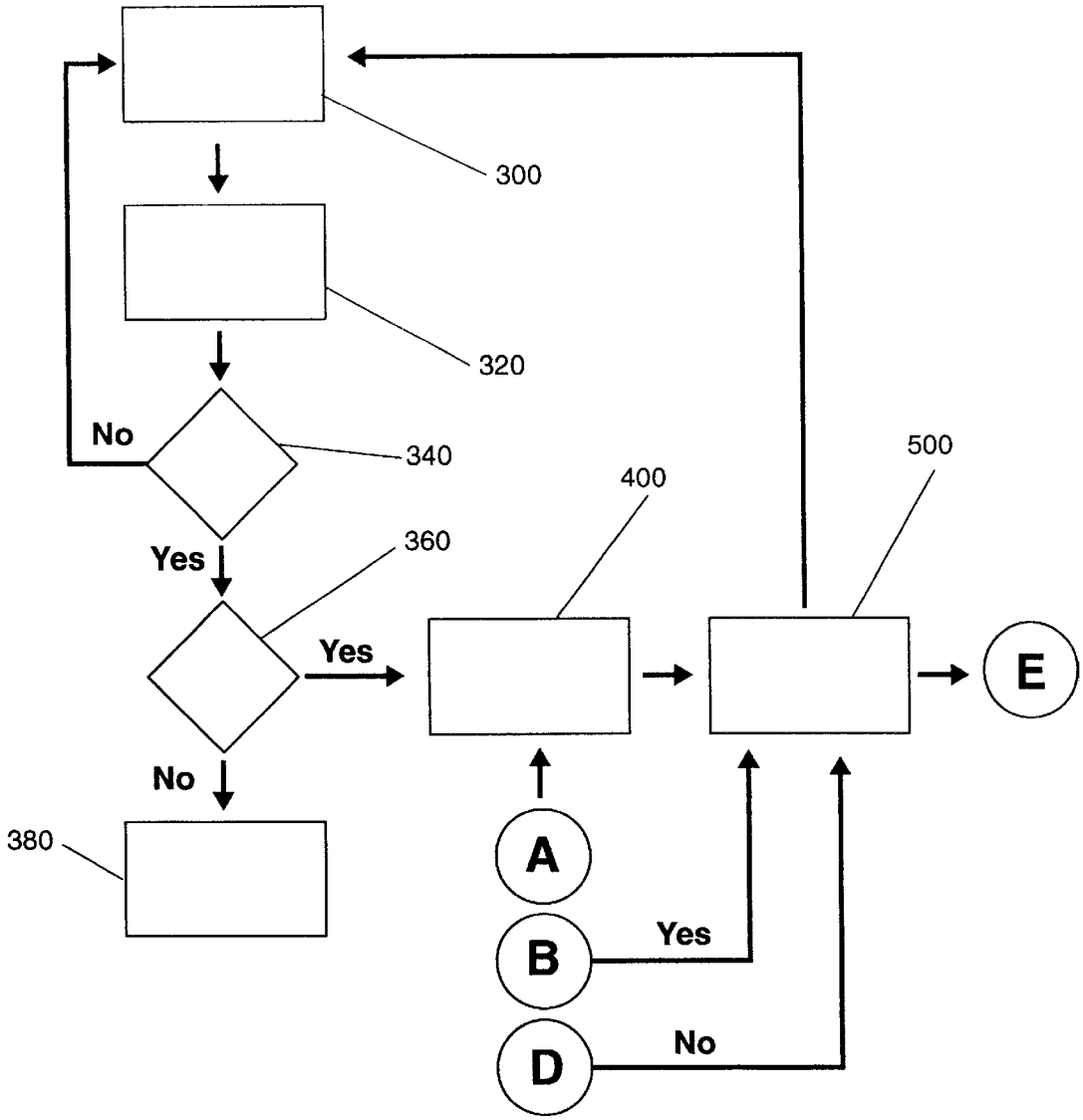
FIGS. 8A, 8B & 8C flowcharts the preferred operation of the present invention.
Figure 8B:
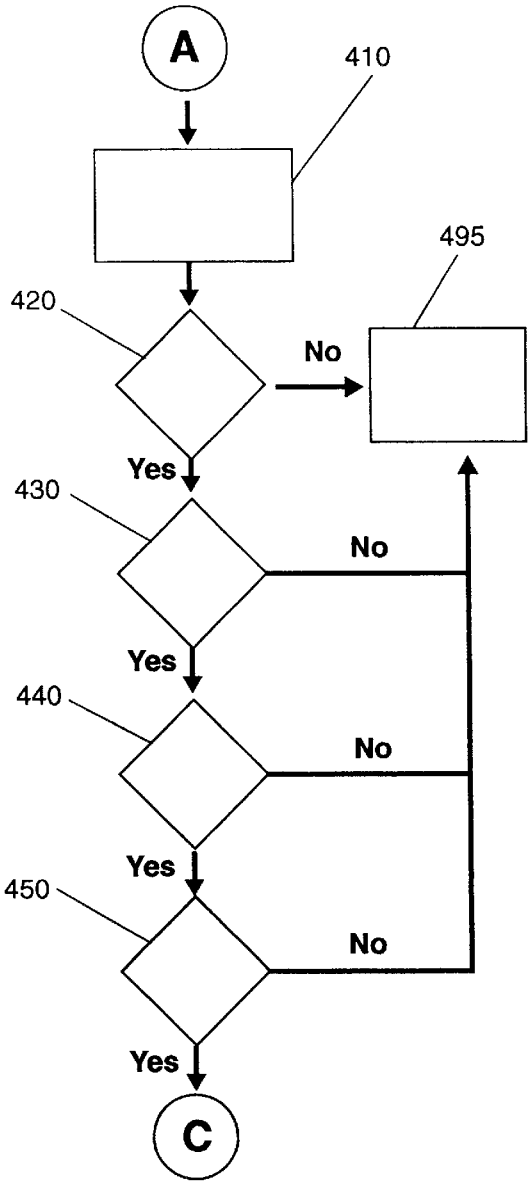
Figure 8C:
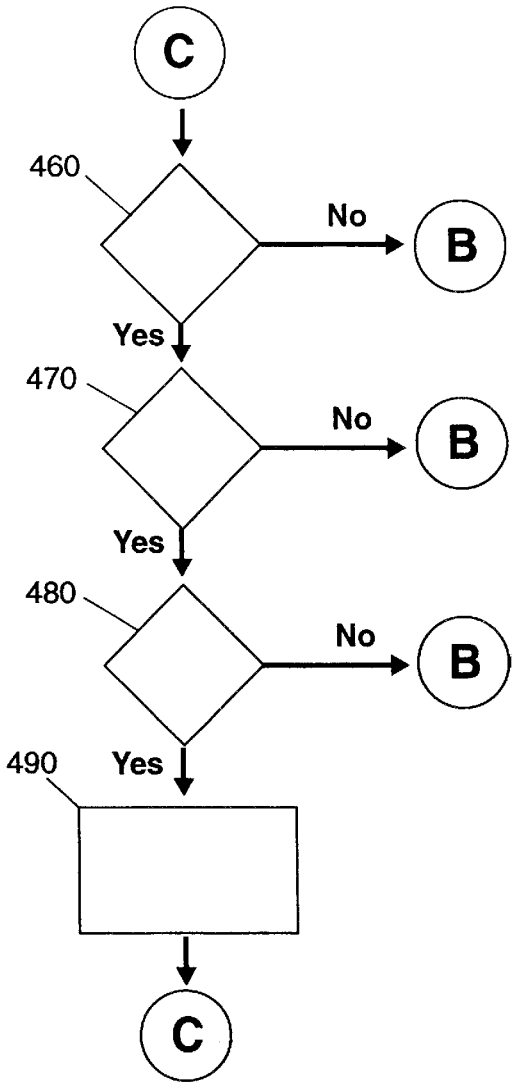

Power supply 150 is needed to drive light emission driver 90 for package sensing; for the package check routine, see FIG. 8A–8C, and for the communication driver 160 for communication to the checkout stand receiver 88. Power supply 140 is for the microcontroller 60 and for the clock circuit 120 being utilized to detect for a package.

The clock circuit 120 is a series of AND gates and sends the right signal for initiating the driver-receiver combination. The clock circuit 120 is for facilitating communication with the checkout stand circuit 100. A signal which is a special code, that either has a leading 1 and 0 or is the opposite way a leading 0 and 1. Simultaneously there are a plurality of clock pulses that occur at 38 kHz from within the internal clock of microcontroller 60. This clock frequency is used to modulate the communication signal that goes to the checkout stand circuit 100 because of the receiver requirements within checkout stand receiver 88 which is an off-the-shelf receiver that only accepts 38 kHz signals. Anything signal above or below that frequency will be rejected by the receiver 88.

FIG. 7 shows the communication between the cart circuitry 50 and the checkout stand circuitry 100. The cart circuitry 50 contains four LEDs for emitters and four phototransistors as receivers for two-way communication 41 (FIG. 2) between itself and the checkout stand circuitry 100. This equates to four emitter-receiver combinations to be utilized as redundancy and to make sure cart's chassis does not interfere with the communication between the cart circuitry 50 and the checkout stand circuitry 100. This communication link is arranged such that the cart's spokes that constitute the grid of the bottom shelf never prevent one emitter-receiver combination from communicating with the checkout stand circuitry. Thusly, there is a communication in both transmission and reception no matter what is the position of spokes that constitute the grid of the shopping cart's chassis 6. This allows the cart circuitry 50 to be portable and allows for its use on any type of shopping cart and is further forgiving as far as light blockage.

The microcontroller 60 generates a "detector enable" signal that actually powers the detector circuit that typically requires 1 mA to 2.1 mA of power to operate. The cart circuitry operates in three distinct power stages. The first stage is considered the sleep mode (quiescent state) which draws little current. The next stage is the read signal stage with draws the above mentioned 1 mA to 2.1 mA of power. The third stage (non-quiescent state) is when the cart circuitry 50 is instructed to check for a package. At this stage the cart circuitry 50 draws its largest amount of current, typically in the tens of mA. Thusly, when no signal is present this essentially shuts down the cart circuitry 50 to where only current is flowing through the microcontroller 60 and any remaining current flow is considered leakage and does not pose a significant drainage on the power supplies 140 and 150 that have a limited duration. The idea is that power has to be conserved because replacement of batteries frequently can be costly. The biasing of the diodes and the "detector enable" signal, see FIG. 4B, to be utilized, minimizes the current drain which in turn will save the batteries. This results in the batteries lasting one year and possibly longer. Since batteries can be costly to replace, this is one reason why there is the inclusion of the biasing resistors within the cart circuitry 50.

The two driver circuits 90 and 160 are wired in such a manner that if the inputs are set in a particular direction the result will be the shutting down of the both of them and there will be just essentially leakage current flowing through the cart circuitry 50. There are five inputs, see FIG. 4B, and when they are positive there is current draw, when they are negative all five of the transistors are shut off.

EEPROM 170 is in bidirectional communication with microcontroller 60. The EEPROM 170 is for future expansion of the present invention. One use would be to keep track of serial numbers of the carts. Communication from the checkout stand circuitry would store the serial number into the EEPROM 170 and then recall the serial number afterwards and send it back to the checkout stand while the cart is going through the check stand. Another use for EEPROM 170 is to have the option of storing the calibration values in the EEPROM at the initial calibration during assembly. Therefore, when the batteries are removed for replacement the calibration data can be recalled.

One of the features of the present invention is the power saving feature. The cart is normally off for a relatively long time, for instance, 0.1 seconds, then it turns on for a very short time, for instance, 1 to 3 milliseconds, and during that time it is looking for a signal from the checkout stand circuitry 100 and if that signal ever goes low (light on) during that time. Because normally, if there is no signal the cart circuitry 50 is set at a high; in other words, the detectors are off so that this is the way the circuitry is biased.

In operation (FIGS. 8A–8C) the cart circuitry 50 receives emissions from its surroundings 300. The cart circuitry 50 proceeds to analyze the emissions it receives 320 and determines whether or not the emission is a valid signal, i.e. is the emission's source from a checkout stand. At this time the current draw is only 1 mA to 2 mA. If the signal is not valid the process returns to receiving emissions at step 300. In other words, it actually check if the signal is a package detect signal or calibration, if neither, that the signal is invalid. If the signal is determined to be valid the process moves to another conditional statement to determine whether the signal which was determined as valid is a package detect signal 360. If the signal is not determined as a package detect signal then by default it is a calibration signal and the process proceeds to the calibration step 380 to calibrate the system as previously mentioned. If the signal is determined to be a package detect signal, then the process proceeds to the check for package routine 400. It is at this stage that the cart circuitry 50 initiates the seven combination emitter-detector sequence previously discussed to scan for the presence of a package. The process begins scanning the bottom shelf 410. As previously stated, the most likely position where a package might be placed on the lower shelf is scanned first. Therefore, the process proceeds through a series of conditions 420, 430, 440, 450, 460, 470, 480 and 490 respectively. If any one registers a false or "no" condition the process jumps to step 495 which halts the energizing of any remaining emitter-detector combination in order to reduce power consumption of the circuit. If all conditions are true or "yes" then the process by default proceeds to the determination that no package is detected. Regardless of whether a true or false condition is present, the process proceeds to transmit the result 500, either true or false, of the check for package routine to the checkout stand and the proceeds to start the process over to step 300.

Figure 5A:
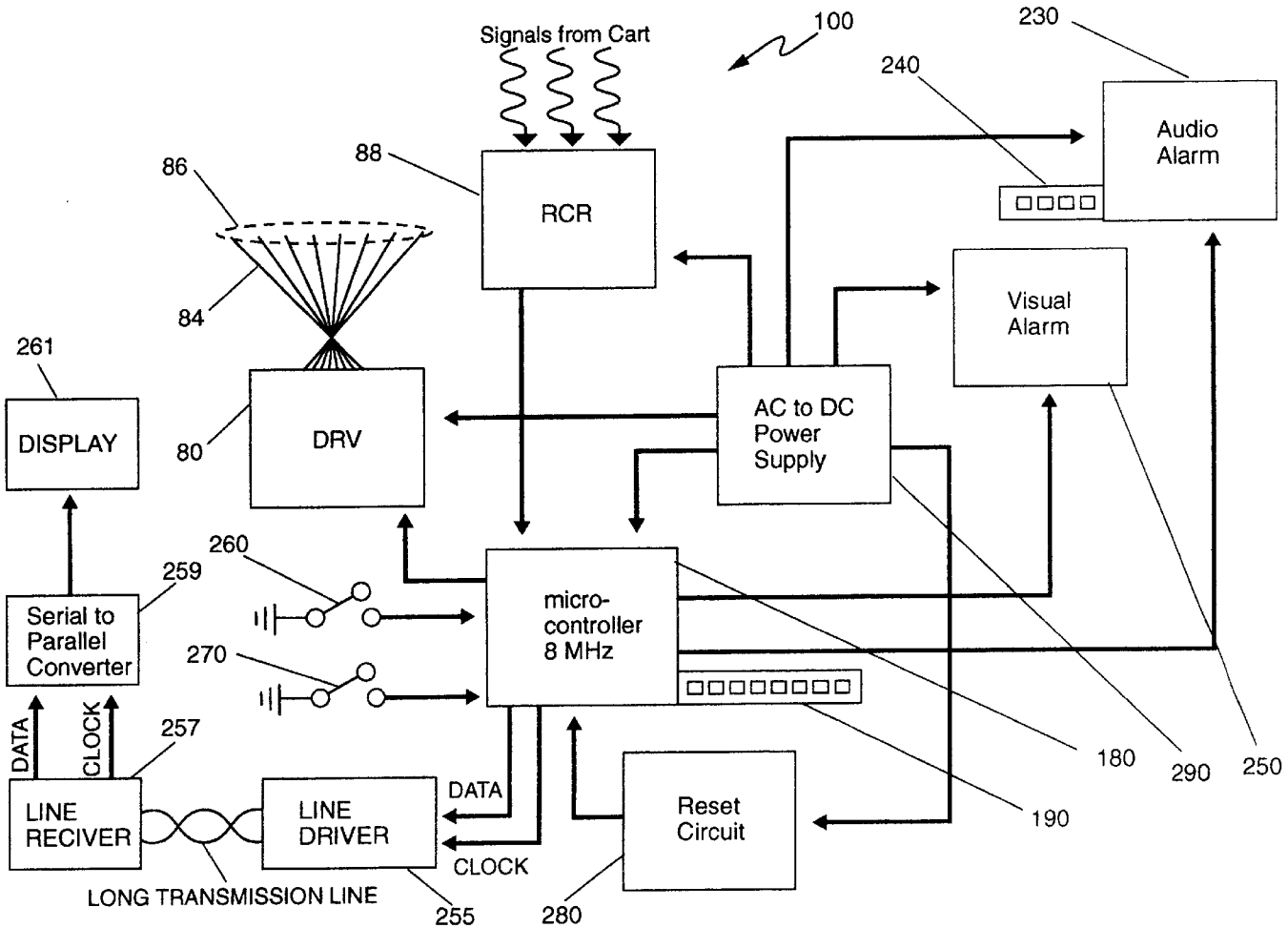
FIG. 5A is a block diagram overviewing the checkout stand circuitry.
Figures 1, 5B:
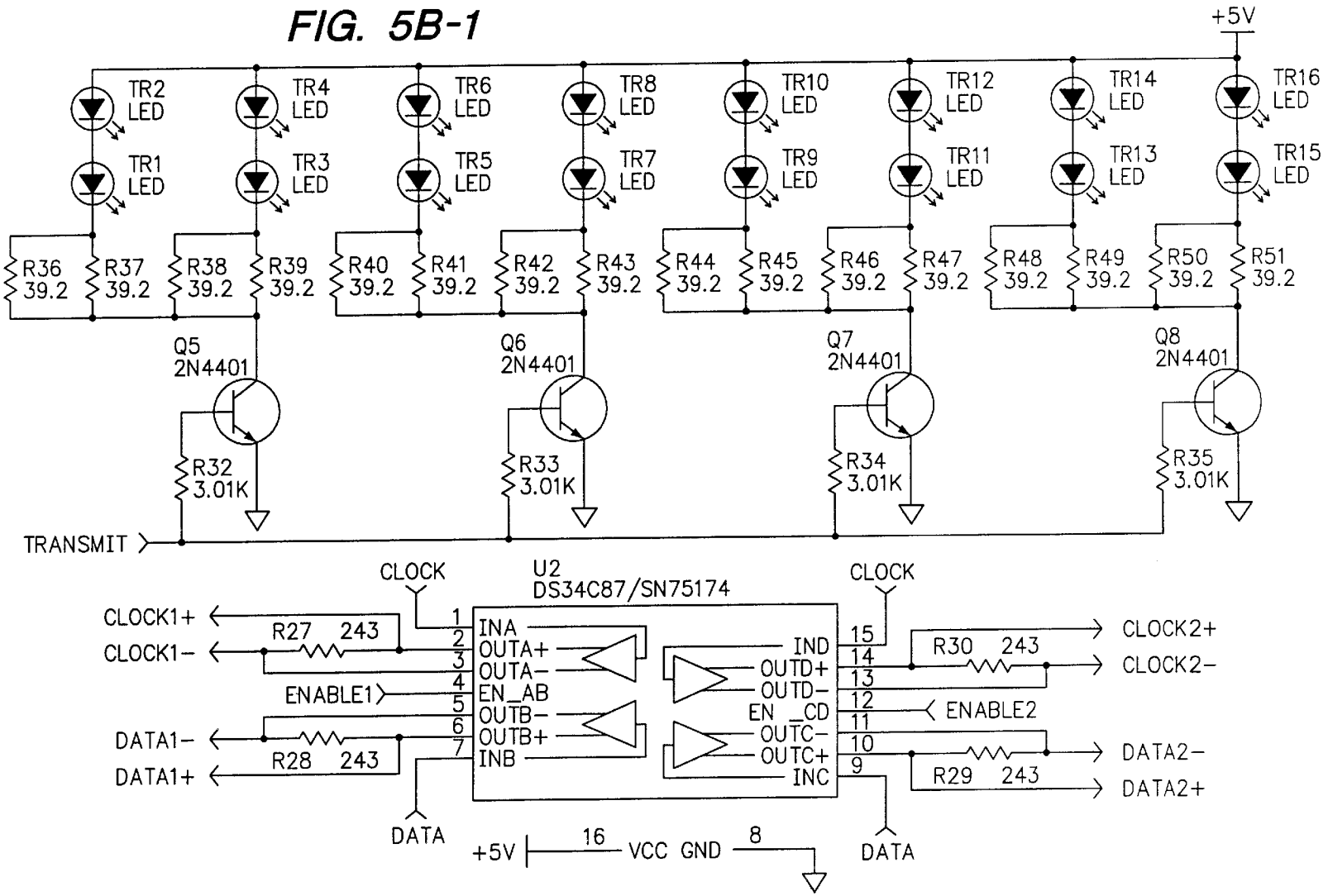
FIG. 5B is a schematic diagram of the preferred embodiment of the check out stand circuitry.
Figures 2, 5B:
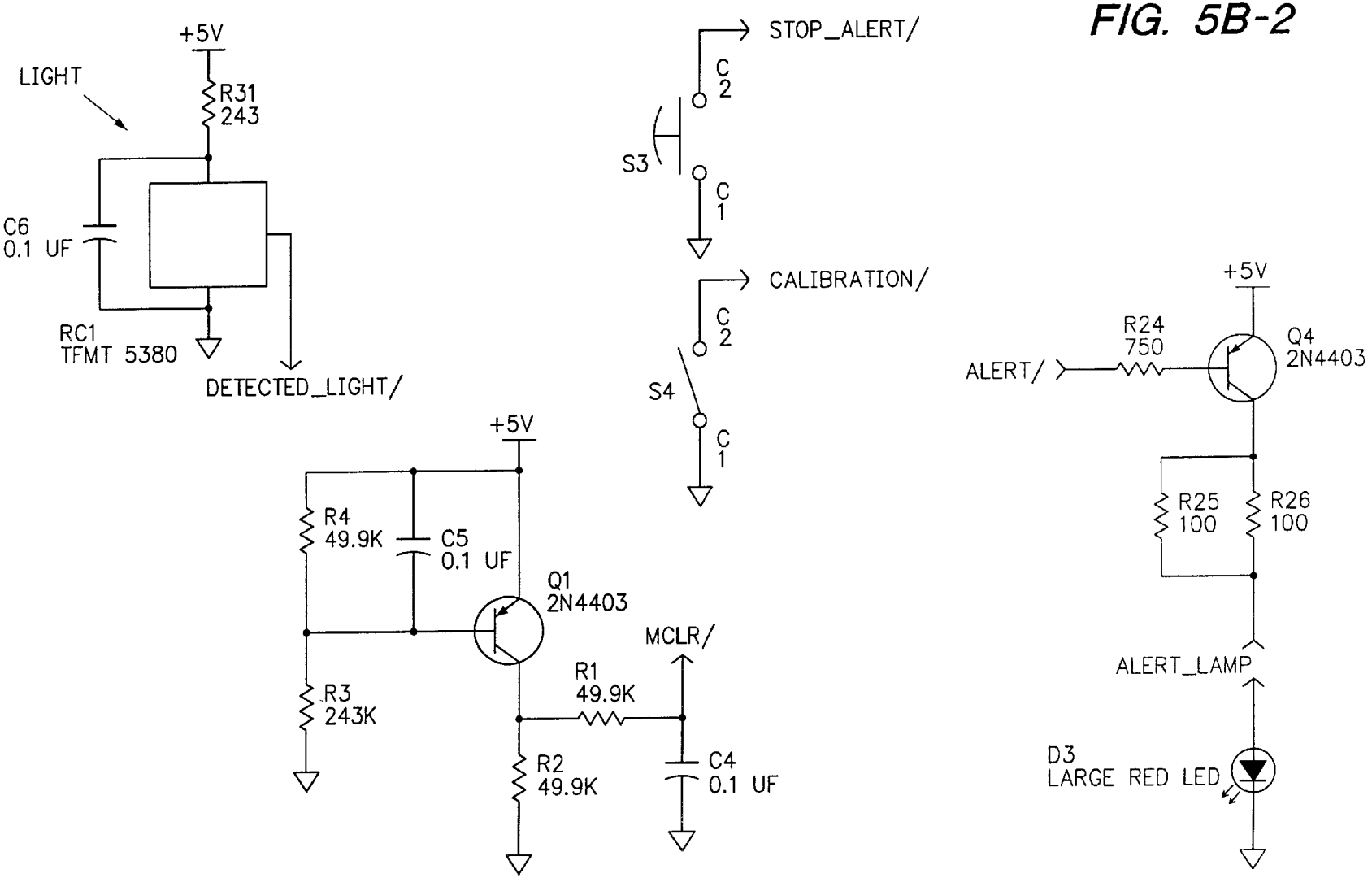
Figures 3, 5B:
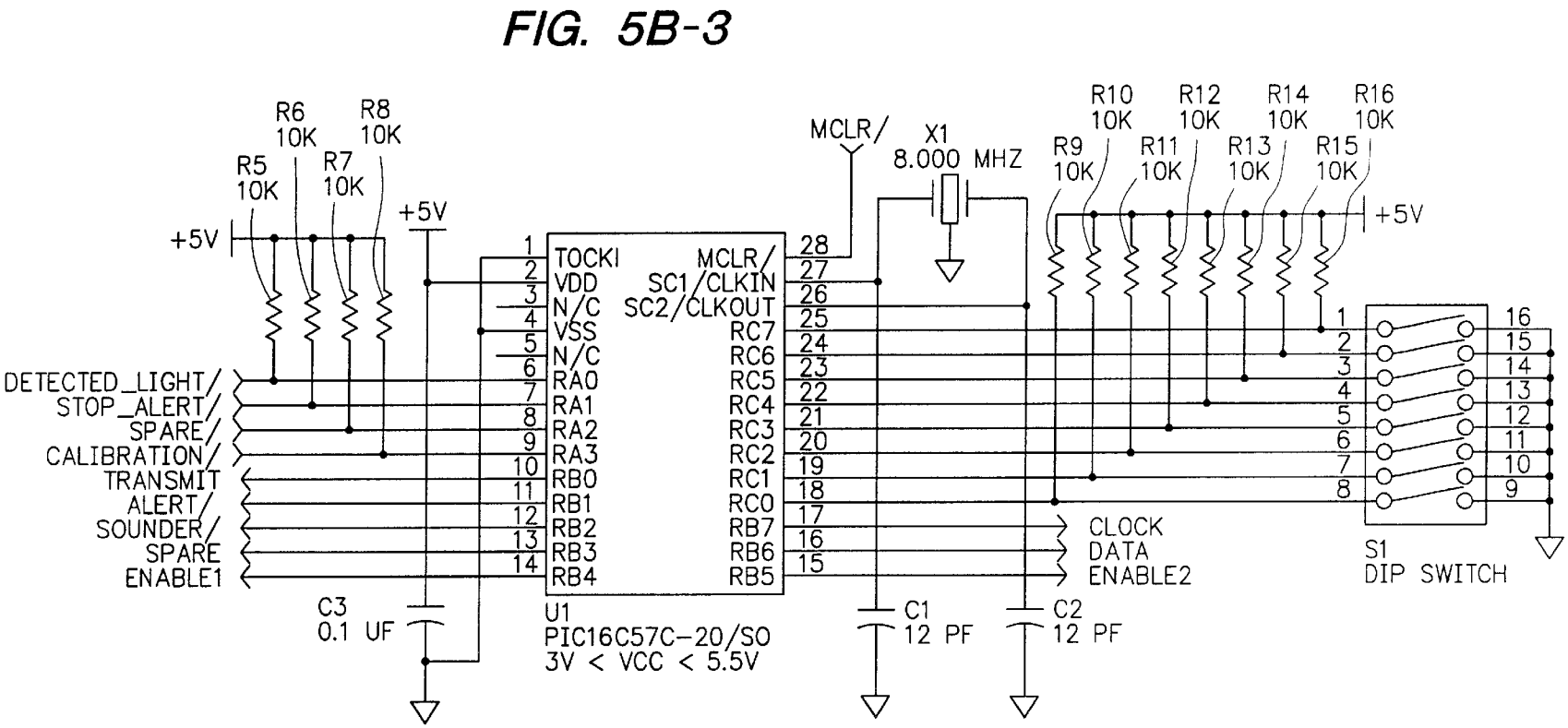
Figures 4, 5B:
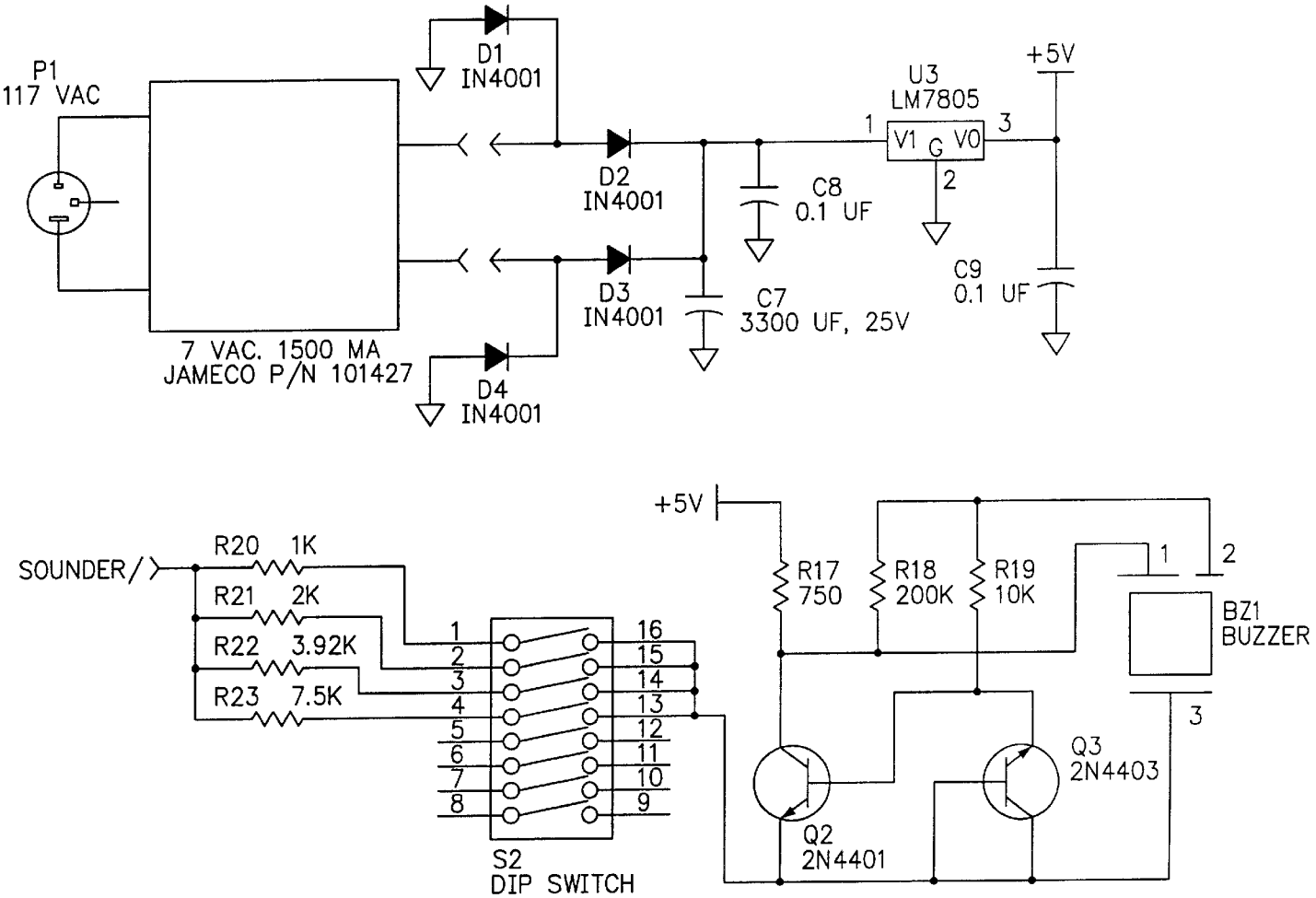

FIG. 5B is the checkout stand schematic and FIG. 5A is a block diagram overviewing the checkout stand's schematic. Microcontroller circuit 180 controls the functionality of the checkout stand circuitry 100. The checkout stand circuitry 100 is powered by AC line power supply 290 that has a regulator and rectifying break circuit to the right, see FIG. 5B. Microcontroller 180 operates at 8 megahertz, because it has a half a microsecond instruction cycle time, it is a convenient number to use, and it is the highest speed that does not require any more components other than the process controller, like, for instance, adding gates, an external oscillator, etc. to increase the frequency to 15 to 20 megahertz. Viewing FIG. 5A, line driver 255, line receiver 257, serial to parallel converter 259 and display 261 are utilized to inform of the number of shopping carts 2 that pass through the checkout stand 11 and the number of shopping carts 2 that contain packages proximate the chassis 6. Other utilities for this circuitry can be developed by one skilled in the art.

The DIP switches 190 are used for the selection of all software options. For example, the frequency of light that blinks when there is a package detected by the circuitry, cycle time of when visual alarm 250 goes on and off, also whether the audio alarm 230 would be utilized. The DIP switches 190 not only determines the on and off time but also how long it should blink on and off or how long the audible indicator 14 should sound on and off. The push button 260 is for the sales clerk to manually shut-off the visual alarm 250 or audible alarm 230 or both. If the sales clerk wants to cut off early the indicators, he or she presses the push button 260. Options include that the alarms can stay on for a set period determined by the switches or alarms could stay on indefinitely. The light (see FIG. 5B and FIG. 1) is just a visual display, a large one to tell the clerk whether there is a package or not. There is also binary weighted DIP switches 240 to control the volume of the sounder or buzzer 230, see FIG. 5B.

The reset circuit 280 is for resetting the controller when the power is first turned on or when a brown or black out occurs or an otherwise off state that would cause the loss of the proper sequence in the software. With such an occurrence it is preferred to reset and reinitialize, so the reset circuit 280 basically reinitializes the software routine so the software starts ab initio. Switch 270 is pressed when the operator wants to send a calibration signal to the cart instead of to check a package.

Accordingly, the reader will now see that the infrared detection and alarm system for the bottom shelf of a shopping cart can be used to prevent shrinkage in a retail environment which uses shopping carts by alerting the sales clerk at the checkout stand that merchandise exists on the bottom shelf of the cart. Furthermore, the present invention is a cost-effective and durable device which will provide a long term solution to the problem of shrinkage caused in part by the failure of sales clerks to account for said merchandise placed on the bottom shelf of shopping carts.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. An apparatus for detecting and alerting, at a point of sale, terminal the presence of merchandise on a shopping cart shelf, comprising:

a. emitter means for generating a scanning wave traversing the shelf of the shopping cart, said emitter means mounted to the shopping cart;

b. a receiver mounted to the shopping cart in opposition to said emitter to receive said scanning wave generated by said emitter means and interacting with merchandise when present on the shopping cart shelf;

c. communication means for generating a wireless signal representing the presence of merchandise on the shopping cart shelf, said communication means mounted on the shopping cart and linked to said receiver; and d. alarm means for issuing a perceptible indication upon receipt of said wireless signal from said communicating means.

2. The apparatus of claim 1 in which said emitter means further comprises an array of emitters spaced from each other in side-by-side configuration.

3. The apparatus of claim 1 in which said wireless signal generated by said communication means comprises a code signal.

4. The apparatus of claim 1 in which said alarm means receiving said wireless signal from said communication means is located in the vicinity of a point of sale terminal.

5. The apparatus of claim 1 which further comprises means for initiating the operation of said emitter means and said receiver by transition from a quiescent state to a non-quiescent state.

6. The apparatus of claim 5 in which said means for initiating the operation of said emitter on said receiver comprises a signal generator located at the point of sale terminal and a signal processor located on the shopping cart, said signal processor being reactive to said signal generator located at the point of sale terminal.

7. The apparatus of claim 6 in which said emitter means further comprises an array of emitters spaced from each other in side-by-side configuration.

8. The apparatus of claim 7 in which said wireless signal generated by said communication means comprises a code signal.

9. The apparatus of claim 8 in which said alarm means receiving said signal from said communication means is located in the vicinity of a point of sale terminal.

* * * * *